US006826814B1

(12) United States Patent
Davis, Jr.

(10) Patent No.: US 6,826,814 B1
(45) Date of Patent: Dec. 7, 2004

(54) YARN TEXTURIZER

(75) Inventor: David M. Davis, Jr., Tunnel Hill, GA (US)

(73) Assignee: Precision Products, Inc., Tunnel Hill, GA (US)

( * ) Notice: Subject to any disclaimer, the term of this patent is extended or adjusted under 35 U.S.C. 154(b) by 0 days.

(21) Appl. No.: 10/673,844

(22) Filed: Sep. 29, 2003

(51) Int. Cl.[7] ..... D02G 1/16
(52) U.S. Cl. ..... 28/271; 28/273
(58) Field of Search ..... 28/271, 272, 273, 28/274, 275, 276, 258, 254, 255, 256, 247, 220; 264/555, 103, 210.8, 211.14; 57/333, 350, 403, 908

(56) References Cited

U.S. PATENT DOCUMENTS 984,195 A * 2/1911 Cooper ..... 19/150
3,633,808 A * 1/1972 Svaty ..... 139/435.4
3,694,131 A * 9/1972 Stuart ..... 425/461
3,745,617 A * 7/1973 Smith, Jr. ..... 28/273
3,916,493 A * 11/1975 Ethridge ..... 28/273
4,069,564 A * 1/1978 Trifunovic et al. ..... 28/273
4,141,122 A * 2/1979 Trifunovic ..... 28/271
4,807,431 A * 2/1989 Braxmeier ..... 57/333
5,433,365 A * 7/1995 Davies ..... 226/97.4
5,526,850 A * 6/1996 Sora et al. ..... 139/435.4
6,088,892 A * 7/2000 Bertsch et al. ..... 28/273
6,199,250 B1 * 3/2001 Ballarati ..... 28/274
6,370,746 B1 * 4/2002 Hinchliffe et al. ..... 28/273

* cited by examiner

*Primary Examiner*—Amy B. Vanatta
(74) *Attorney, Agent, or Firm*—Stephen J. Stark; Miller & Martin PLLC

(57) ABSTRACT

A texturizer is a base which provides a plurality of inlets directed to stations internal to the base. Each of the stations communicate internal to housings which have inserts therein. Receivers in the inserts receive air from the stations and direct the air towards distal ends of the housings through slots. Prior to reaching the distal ends of the inserts, passages through the inserts direct air to an internal bore in the insert and proximally out the insert bore. The insert bore extends all the way through the insert and through the housing so that yarn is pulled through the housing and crimped preferably at an impingement point in the insert.

17 Claims, 2 Drawing Sheets

YARN TEXTURIZER

FIELD OF THE INVENTION

The present invention relates to a yarn texturizer and a multiple port yarn texturizer having an improved insert construction.

BRIEF DESCRIPTION OF RELATED ART

In the prior art, yarn texturizers generally have inserts which fit within housings in a base. The inserts are comprised of an elongated member having a divergent head which terminates within the housing as shown in FIG. 1. Air passes around the elongated body. As the air passes by a twist member, rotation is imparted to the air. The spinning air continues about the divergent end where it reverses course and flows into a bore disposed within a convergent section at the distal end of the insert. The housing extends past and over the distal end of the insert to assist in directing the air flow.

Yarn is normally fed through a hollow adjusting screw located above the bore in the insert. The screw extends through the prior art housing. Depending upon the extent to which the screw is inserted or backed out relative to the bore in the insert, the amount of vacuum experienced at the inlet to the bore which is adjusted. One problem with the prior art designs is that operators can unknowingly affect the performance of the yarn set or crimp by moving the screw relative to the bore. Some operators might prefer the screws backed out while other operators may prefer them as tight as possible. While this may not directly affect the operator, it produces a different set in the yarn which can be visible when tufted into a carpet to affect the runability of the downstream processes. Furthermore, the screws can become loose or galled over time thereby affecting the performance of the prior art design. Additionally, since texturizers typically have multiple stations, producing the exact same crimp in the yarn through the various stations may be difficult when each station is manually adjustable.

A second prior art design shown in FIG. 2 has a similar insert construction but the screw or conical needle as it is often called is connected to a plunger which may be moved by air pressure up and down to assist in threading yarn through the insert and conical needle. Specifically, when the plunger is pushed towards an up position, shown in phantom, the amount of suction into the bore of the insert is significantly less which makes it much easier for the operator to thread up the texturizer station. Once threaded, the plunger may be returned to an operational position. Once again, the moving nature of the conical needle relative to the bore of the insert provides parts which wear over time and are subject to failure. Furthermore, this type of design is normally provided with adjustment parts to allow for the adjustment of the limits of travel of the plunger so that an operator can once again drastically affect the performance of the yarn as it is texturized by the texturizer of the prior art in FIG. 2.

In both prior art designs air passes around the diverging distal end of the insert from all 360 degrees and then is directed through the bore as the insert narrows from the end to the entrance of the bore as shown. This 360 degree of air coverage provides somewhat of a donut that then narrows about the yarn as shown in FIG. 1 to then pull it through the bore while also simultaneously performing the crimping and/or setting of the yarn as it passes through the texturizer. While the donut technique obviously works as it has been utilized in the prior art, it is not believed to be the optimum way to direct air through a texturizer to provide the most desirable and consistent crimp to the yarn.

SUMMARY OF THE INVENTION

Accordingly, an object of the invention is to provide an improved texturizer that does not rely on an adjustment of individual stations or allow operators the opportunity to get stations out of adjustment.

Another object of the present invention is to remove threaded components which could otherwise gall, seize, or be misadjusted.

It is another object of the present invention to provide more consistent running of the product through a texturizer.

It is another object of the present invention to provide better overall runability and increase the efficiency of air-to-yarn concentration.

It is another object of the present invention to reduce the potential maintenance associated with the texturizer.

Accordingly, a texturizer of the presently preferred embodiment of the present invention has at least one station, each station having a housing surrounding an insert. Unlike prior art inserts which typically have a significantly smaller cross section along a majority of the length until the distal end of the insert, the preferred embodiment of the present invention employs an insert having a collar with an outer surface which substantially corresponds with the internal surface of the housing except for a plurality of slots which extend along the inner surface of the housing to provide channels to direct air flow.

Specifically air flows through the slots towards a distal end of the insert. Prior to reaching the distal end of the insert, proximally angled inwardly directed passages direct air from the slots towards the insert bore which extends through the center of the insert along a yarn travel axis. These inwardly directed passages are in communication with the slots so that air proceeds distally towards the distal end of the insert along the slots and then reverses direction towards the proximal end or discharge end of the texturizer insert through the passages. The inwardly directed passages preferably have axes which intersect along the yarn travel axis of the bore at an impingement point. By providing direct impingement at a single point, better overall runability is achieved and more efficient air-to-yarn concentrations achieved. More consistent running of the product is also achieved and less maintenance issues are encountered over the life of the texturizer. Although the preferred embodiment envisions opposing slots symmetrically arranged about the yarn or travel axis, other embodiments then may have three or more slots and may meet at more than one impingement point within the bore axis.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
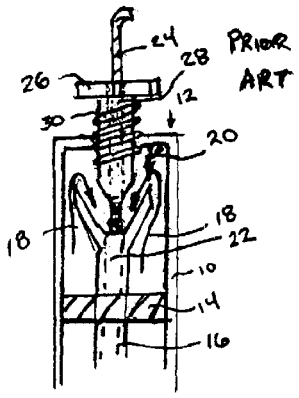
FIG. 1 shows a cross section portion of a first prior art texturizer port showing an insert located proximately from a hollow conical needle located at the distal end of a housing.
Figure 2:
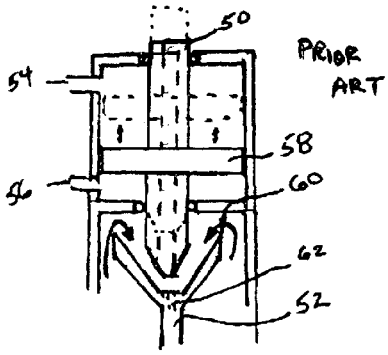
FIG. 2 is a second prior art texturizer cross section portion having a conical needle connected to a plunger moveable with air pressure to provide for easy threading of the insert with yarn.

In prior art texturizer designs shown in FIG. 1 and FIG. 2, pressurized air is directed into a housing 10 from a manifold connected through a base (not shown). As the air proceeded distally towards top end 12 from internal to the housing it passes through vanes 14 which are machined into an insert 16 to impart rotational forces to the pressurized air illustrated as arrows 18. The swirling air is then be directed about the distal end 20 of the insert 16 which diverges at its distal end along its external surface and then narrows towards a bore 20 as yarn 24 proceeds from the distal end 20 toward the proximal end to the insert 16. As the arrows 18 (representing air flow) proceed around the distal end 20, a donut of air is effectively formed which constricts about the yarn 24 to pull it through the bore 22 as well as impart crimp the yarn 24 and thus texturize the yarn 24 as it proceeds through the texturizer.

In the design of FIG. 1, an adjustment screw 26 having a bore 28 therethrough is utilized to adjust the amount of vacuum experienced by the yarn 24 as it proceeds into the bore 22 of the insert 16. Operators are prone to haphazardly adjust the adjusting screw 26 (i.e., some would back it all the way out, some would crank it all the way in). Unfortunately, moving the screw affects the crimp of the yarn 24 which can be observed in finished tufted carpet product. Furthermore, the ability to move the screw relative to the insert can result in galling of the housing or screw threads. Finally, the moving of the threads 30 relative to the housing 10 can become loose over time thereby affecting the quality and/or consistency of the texturized yarn product.

FIG. 2 shows a second prior art design which includes a moveable conical needle 50 relative to insert 52. Air ports 54,56 allow the plunger 58 to be moved to the up position shown in phantom in FIG. 2 which moves the conical needle 50 distally from the insert 52. This has been found to be helpful in order to reduce the vacuum quickly to allow yarn to be threaded into the insert. Internal screw adjustments are normally provided to allow for the adjustment of the spacing of the needle 50 from the insert. This design provides further complicated structure and provides more moving parts which could fail over time. Once again, this product design relies upon a ring or donut for the air to be directed around the distal end 60 of the insert 52 towards the bore 62 to texturize yarn.

In both prior art designs, the inserts 16,52 have expanding cross sectional surface area across the exterior surface at the distal ends while having narrowing surface areas across internal surfaces proceeding proximally from the distal ends 20,60 toward the insert bores.

Figure 3:
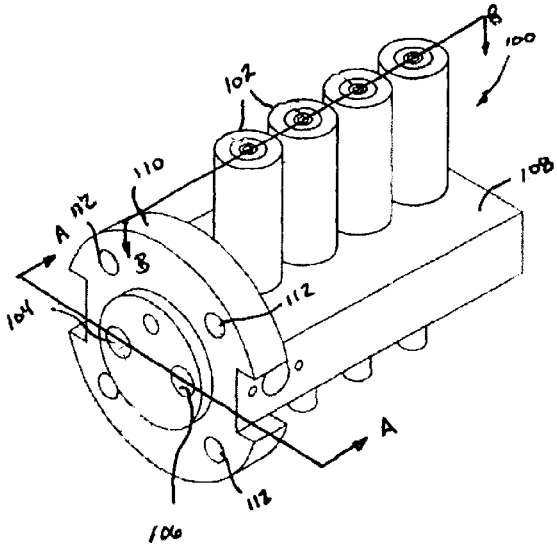
FIG. 3 is a top perspective view of an assembled texturizer according to the presently preferred embodiment of the present invention.

FIG. 3 illustrates a presently preferred embodiment of the present invention. Texturizers 100 can vary in the number of ports and in the arrangement of air. The specific configuration of air provided from an air supply to the individual housings 102 illustrated in FIG. 3 is one example. This embodiment of a texturizer 100 is believed to provide sufficient detail to one of ordinary skill in the art to show how other embodiments would also operate.

Figure 4:
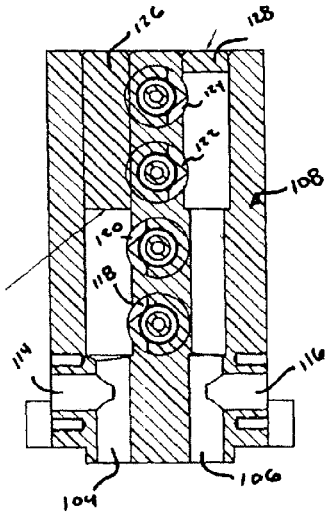
FIG. 4 is a cross-sectional view taken along the line A—A of FIG. 3.

Treated air is provided through inlets 104,106 into texturizer base 108. Flange 110 is useful in connecting the inlets 104,106 to their respective air supplies at a manufacturing facility having the necessary equipment. Bolt holes 112 receive bolts therethrough to connect to the necessary air supply equipment. Air enters the inlets 104,106 as shown in FIG. 4.

As air proceeds into the inlets 104,106 it is preferably directed past thermocouple ports 114,116 which house thermocouples or other temperature sensors utilized to measure the temperature of the air supply provided into inlets 104, 106. In the texturizing yarn it is normally important to maintain the inlet air supply and desired temperature or temperature range since air temperature and pressure both can drastically affect the crimp of the yarn as it leaves the texturizer 100.

Although many texturizer embodiments provide a single inlet 104 or 106 for a single station, in this embodiment a single inlet 104 or 106 provides each of two stations respectively. Specifically, first inlet 104 provides air to first and second stations 118,120, while second inlet 102 provides air into third and fourth stations 122,124. Plugs 126,128 are useful in directing the flow of air to stations internal to the base 108 and simplifying machining processes.

Figure 5:
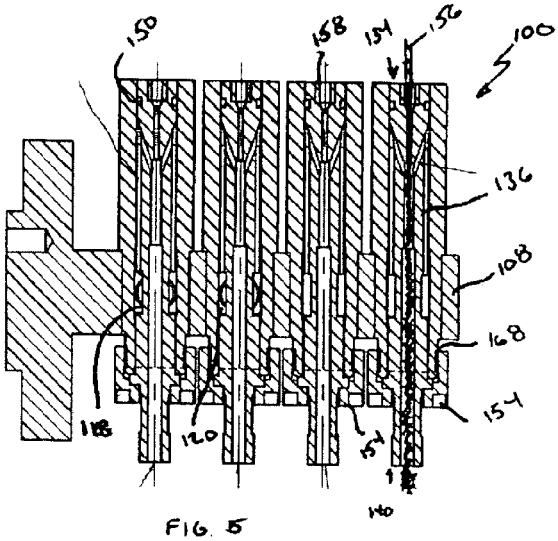
FIG. 5 is a cross-sectional view taken along the line B—B of FIG. 3.
Figure 6:
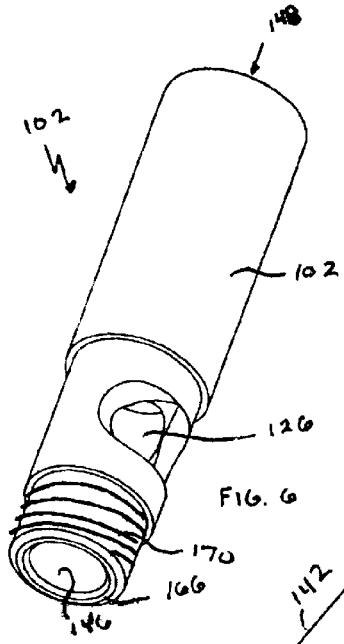
FIG. 6 is one of the plurality of housings shown in FIGS. 3–5.

In reference to FIG. 5 showing texturizer 100, differences between the presently preferred embodiment of the present invention and the prior art begin to thoroughly distinguish themselves. Since FIG. 5 is a cross section taken along the center line only the first and second stations 118,120 are illustrated since the third and fourth stations 122,124 are obscured from view in this cutaway view. As the air proceeds from the respective stations it enters ducts 126 shown in FIG. 6. These ducts 126 have been machined into the housing 102 and provided for air communication to flow from the inlets 104,106 through the respective stations 118,120,122,124 and then through the ducts 126 internal to the housings 102.

Figure 7:
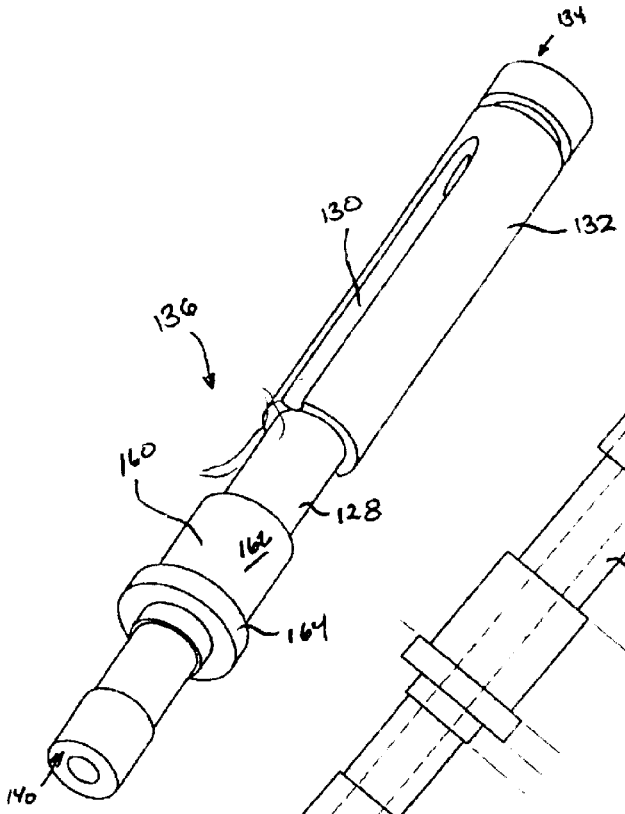
FIG. 7 is a side elevational view of an insert taken from the texturizer of FIG. 3.
Figure 8:
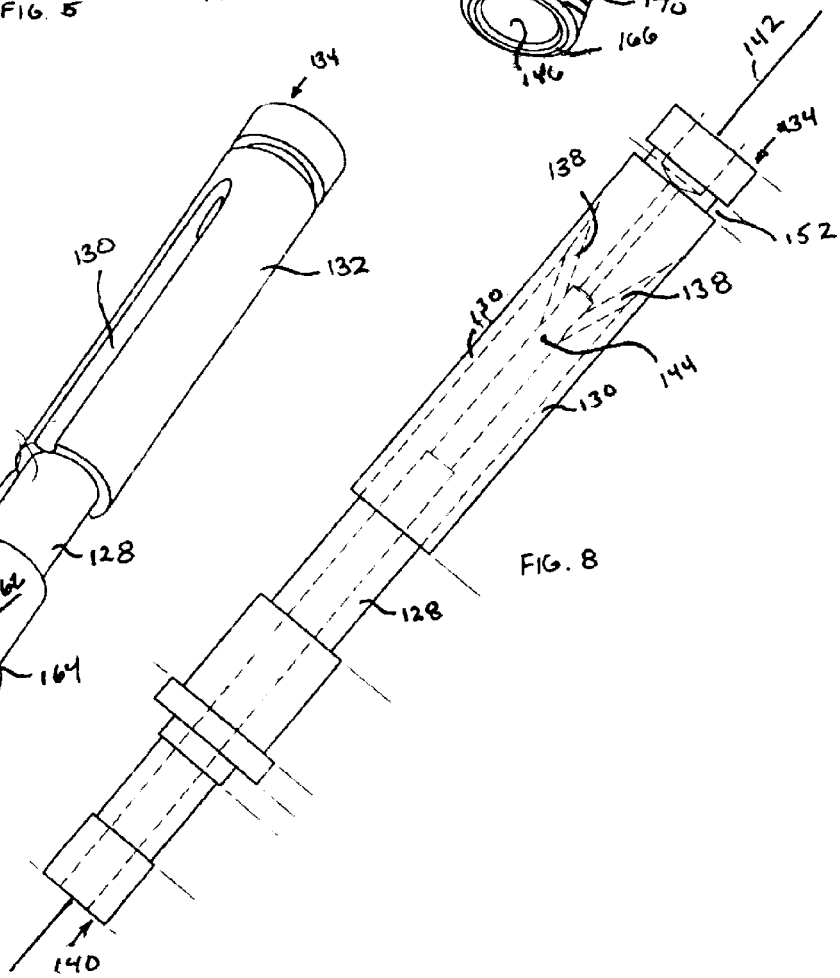
FIG. 8 is a side plan view of the insert of FIG. 7 with internal parts shown in phantom.

As air passes through the ducts 126 it surrounds the receivers 128 of the respective inserts 136 shown in FIGS. 7 and 8. While the air may surround the receivers 128 360 degrees as is done in the prior art, it is channeled through slots 130 disposed in collar 132 so that air can proceed from the receiver 128 through the slots 130 towards the distal end 134 of the respective insert 136. Instead of reaching the distal end 134 as is done in the prior art while diverging, the air flow is maintained through the respective slots 130 until reaching respective passages 138.

The passages 138 preferably proceed from a distal exterior portion of the collar 132 of the insert 136 in the slot 130 towards the proximal end 140. Although the passage 138 is illustrated as being directed about 20 degrees relative to yarn travel axis 142 other relationships between about 10 to about 80 degrees could be utilized. Furthermore, the passages 130,132 are preferably symmetrical as illustrated. As yarn is run along the yarn travel axis 142, it is drawn by the pressure differential caused by the air flow through the passage 138 towards impingement point 144. The force of the air through the passages 138 contacting the yarn (shown in FIG. 5 in one of the four inserts) causes the yarn to crimp primarily due to the impingement force at the single impingement point 144.

Instead of providing a 360 degree circle or donut of air about the yarn, the direction of air through slots and passages 130,138 to impingement or pinch point 144, more efficient air-to-yarn concentration is achieved resulting in more consistent running of product. Furthermore, a lack of moving parts between the distal end 146 and the housing provides an impingement point 144 in which no threaded components can gall, seize, or otherwise be subject to undesirable adjustment by operators. Since there is no operator adjustment provided by the texturizer 100 design, better overall runability is achieved (i.e., as long as the same pressure and temperature are provided through the inlets 104,106 and provided with the same yarn inserted at the distal ends 134 of the inserts 136, a more consistent and high quality output will be discharged from the proximal ends 140 of the inserts 136.) In fact, runability has been found to increase from about 95% in the prior art texturizers to slightly over 98% through the use of the preferred embodiment.

In the prior art, air would be disposed around a receiver and would be similarly spaced apart from the internal surface of the housing. The insert would remain spaced apart from the housing interior surface until encountering the diverging end of the insert and the distal end of the housing.

In the design in accordance with the presently preferred embodiment, the collar 132 substantially corresponds with the internal surface of the housing 146 except for the slots 130 which allow air to be communicated from the receiver 128 through the slots 130 to the passages 138. The passages 138 are spaced from the distal end 134 of the insert 136. An O-ring 150 as shown in FIG. 5 is installed about groove 152 shown in FIG. 8 to provide an airtight seal. Caps 154 retain the inserts 136 in the housings 102. The housings are preferably silver soldered or otherwise attached to the base 108 to the form air tight connections therewith.

Although two slots 130 which oppose the yarn travel axis 142 and extend radially therefrom are illustrated, it is alternatively possible that three or more circumferentially or radially equally spaced passages 138 and slots 130 can be employed. Furthermore these airways may also be symmetrical about the yarn travel axis 142 especially when there are an even number of passages provided. In accordance with this embodiment, the collar 132 separates the slots 130 from one another. In FIG. 5, the yarn 156 is shown inserted into the distal end 134 at the insert 136 as it proceeds to the impingement point 144 and is crimped to the desired state and proceeds on out of the proximal end 140.

A ceramic insert 158 is helpful in preventing the yarn 136 from inadvertently being cut as it passes through the distal end 134.

As shown in FIG. 7, a shank base 160 is located below the receiver 128. The shank base 160 preferably has an exterior surface 162 which substantially corresponds with the interior surface 146 of the housing 102 so that it effectively forms an air tight seal with the shoulder 164 contacting bottom 166 of the housing 102. The cap 154 is preferably equipped with internal threads 168 which cooperate with external threads 170 on the housing 102 to secure the insert 136 within the housing 102.

Numerous alterations of the structure herein disclosed will suggest themselves to those it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A texturizer comprising:

a base having a first inlet ducted to a first station;

a first housing having a proximal and a distal end, an internal housing bore and a duct intermediate the proximal and distal ends of the first housing, said duct providing fluid communication from the first station to the housing bore;

a first insert having a proximal and distal end and an insert bore extending through the first insert along a yarn travel axis, said first insert having a receiver located at least partially in the housing bore at the duct and a collar disposed toward the distal end of the first insert, said collar having at least two slots disposed along an outer surface of the collar, said slots extending distally from the receiver toward the distal end of the first insert, said collar also having passageways corresponding respectively to the slots, said passageways proceeding proximally from the slots into the insert bore to provide fluid communication from the slots to the insert bore.

2. The texturizer of claim 1 wherein each of the passageways are similarly angled relative to the yarn travel axis wherein air directed through the passageways meets at an impingement point.

3. The texturizer of claim 1 wherein the slots and passageways are circumferentially spaced apart from one another about the collar and separated from one another by the collar.

4. The texturizer of claim 1 wherein the distal end of the insert extends at least substantially to the distal end of the housing.

5. The texturizer of claim 1 further comprising a seal preventing air flow from the receiver past the distal end of the insert.

6. The texturizer of claim 1 wherein the first housing and first insert are respectively, ones of a plurality of similarly constructed housings and inserts connected to the base.

7. The texturizer of claim 6 further comprising a second inlet and a second station, said second inlet in fluid communication with the second station, and a second housing of the plurality of housings connected to the base at the second station with a second insert of the plurality of inserts disposed at least partially inside.

8. A texturizer comprising:

a base having a first inlet ducted to at least one station;

a first housing having a proximal and a distal end, an internal housing bore having an internal surface, and a duct intermediate the proximal and distal ends of the first housing, said duct providing fluid communication from one of the at least one stations to the housing bore, said first housing connected to the base;

a first insert having a proximal and distal end and an insert bore extending through the first insert along a yarn travel axis, said first insert having a receiver and a collar disposed toward the distal end of the first insert, said collar having an exterior surface substantially adjacent a portion of the internal surface of the housing bore;

slots located in the collar extending from the receiver toward the distal end of the collar, said slots spaced apart and separated from one another by the collar, each of said slots having a corresponding passage extending from the respective slot proximally into the insert bore.

9. The texturizer of claim 8 wherein the collar has an exterior surface and the slots extend radially inwardly from the exterior surface of the collar.

10. The texturizer of claim 8 further comprising a seal intermediate the insert and the housing bore located distally from the slots.

11. The texturizer of claim 8 wherein the passages are angled similarly relative to the yarn travel axis.

12. The texturizer of claim 8 wherein the housing forms an air tight seal relative to the base, and a shank base is located proximally from the reciever in the housing bore to assist in directing air from the receiver through the slots.

13. The texturizer of claim 8 wherein the collar has an outer surface which is received within an inner surface of the housing bore and the slots are disposed along the outer surface of the collar and terminate prior to reaching the distal end of the insert.

14. The texturizer of claim 8 wherein the first housing and first insert are respectively ones of a plurality of housings and inserts connected to the base.

15. A texturizer comprising:

a base having a first inlet ducted to at least one station;

a first housing having a proximal and a distal end, an internal housing bore having an internal surface, and a duct intermediate the proximal and distal ends of the first housing, said duct providing fluid communication from one of the at least one stations to the housing bore, said first housing connected to the base;

a first insert having a proximal and distal end and an insert bore extending through the first insert along a yarn travel axis, said first insert having a collar with an exterior surface, said first insert located at least partially within the housing bore the insert comprising a receiver located proximate to the duct of the housing;

passages extending proximally from the exterior surface of the collar intermediate the proximal and distal end of the insert into the insert bore; and slots communicating the passages with the receiver.

16. The texturizer of claim 15 wherein the slots extend from the receiver toward the distal end of the insert and terminate prior to reaching the distal end of the insert.

17. The texturizer of claim 15 further comprising a seal intermediate the slots and distal end of the insert, said seal providing a barrier intermediate the outer surface of the collar and the internal surface of the housing bore.

* * * * *